United States Patent [19]

Buckle

[11] Patent Number: 4,786,196

[45] Date of Patent: Nov. 22, 1988

[54] PENCIL WITH A TAPERED FOLLOWER

[75] Inventor: Valerie A. Buckle, Wokingham, England

[73] Assignee: The Gillette Company, Boston, Mass.

[21] Appl. No.: 612,930

[22] Filed: May 22, 1984

[51] Int. Cl.[4] ..... B43K 21/06

[52] U.S. Cl. ..... 401/82; 401/87

[58] Field of Search ..... 401/82, 83, 84, 87

[56] References Cited

U.S. PATENT DOCUMENTS

| | | | |
|---|---|---|---|
| 294,756 | 3/1884 | Brown | 401/82 |
| 388,015 | 8/1888 | Boman | 401/83 |
| 1,621,945 | 3/1927 | Mitchell | 401/83 |
| 2,132,633 | 10/1938 | Kosta | 401/84 |
| 3,265,201 | 8/1966 | Edwards | 401/84 |

FOREIGN PATENT DOCUMENTS

| | | | |
|---|---|---|---|
| 2854285 | 6/1979 | Fed. Rep. of Germany | 401/82 |
| 120538 | 11/1918 | United Kingdom | 401/82 |
| 198834 | 6/1923 | United Kingdom | 401/82 |
| 463878 | 4/1937 | United Kingdom | 401/84 |

*Primary Examiner*—Steven A. Bratlie

*Attorney, Agent, or Firm*—John P. Morley

[57] ABSTRACT

A propelling pencil comprising a body (1, 2), a lead follower (8) and a length of lead (7) supported between the forward end part (1) of the body and the follower. To minimize risk of lead breakages due to shock forces, the lead enters the follower through a smoothly tapering socket (12) and enters the bore (6) at the forward end of the body through a smoothly tapering recess (15).

10 Claims, 1 Drawing Sheet

PENCIL WITH A TAPERED FOLLOWER

This invention relates to pencils.

Conventional wooden pencils have well known disadvantages in that they require frequent re-sharpening, and it is impossible to make use of the full length of the pencil lead. The pencils are usually discarded when their length has been reduced to a few inches since they become difficult to hold comfortably. Propelling pencils which overcome these drawbacks have been available for many years, but their manufacturing costs are relatively high, making the initial purchase prices of propelling pencils substantially greater than those of wooden pencils. As a consequence, sales of wooden pencils remain very substantial.

The aim of the present invention is to provide a pencil which avoids the disadvantages of wooden pencils, is inexpensive to manufacture in comparison with known propelling pencils, and performs satisfactorily in use. The invention concerns particularly a pencil of a form comprising an elongate body having an axial bore, a lead follower received in the bore for sliding movement longitudinally of the body, a pencil lead received in the bore and having the trailing end thereof supported by the lead follower, and means acting between the lead follower and the body to allow forward displacement of the follower to advance the leading end of the lead but to restrain rearward displacement of the follower under normal writing pressure applied to the leading end of the lead.

Tests carried out with pencils of this form have shown that they suffer a serious practical drawback because the lead is without any lateral support over the major part of its length. Currently available conventional leads are too brittle to support any significant shock loads and drop tests. Tests involving dropping pencils onto the floor from desk height have revealed an unacceptable lead breakage rate. In the majority of cases, fracture occurred adjacent the follower rendering the pencil useless.

A simple but very effective solution has been found to this problem, and according to the invention, the trailing end of the lead is received in a socket in the follower, the socket having an inner portion into which the lead fits with a close fit, a mouth of diameter substantially greater than that of the lead, and an inwardly tapering portion leading to the inner portion and having a smooth transition therewith. In a preferred construction, the socket is shaped as a trumpet with a cylindrical inner portion which receives the lead with a tight fit. To reduce further the chance of lead fracture under a sudden shock, a recess of similar shape to the socket may be provided in a part of the body at the writing end having a bore in which the lead slides, the mouth of the recess facing rearwardly towards the follower.

By means of the invention, it has been found during drop testing that lead breakages can be reduced to a very satisfactory level of less than 1%.

In a preferred pencil embodying the invention, the body has a longitudinal slot opening into the bore, and a slide member, including the lead follower, projects through the slot and engages frictionally the opposite sides of the slot. The friction forces are easily overcome by finger pressure to adjust the lead position, but the slide member remains fixed with respect to the body under normal writing pressure exerted on the writing tip of the lead.

A better understanding of the invention will be had from the following detailed description given by way of example with reference to the accompanying drawings, in which FIG. 1 shows a side elevation of a pencil embodying the invention;

Figure 1:
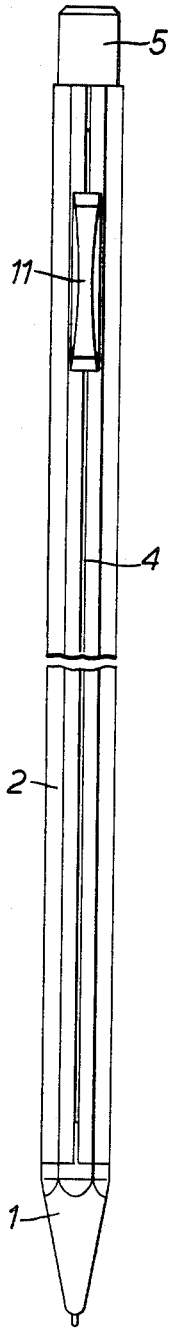
Figure 2:
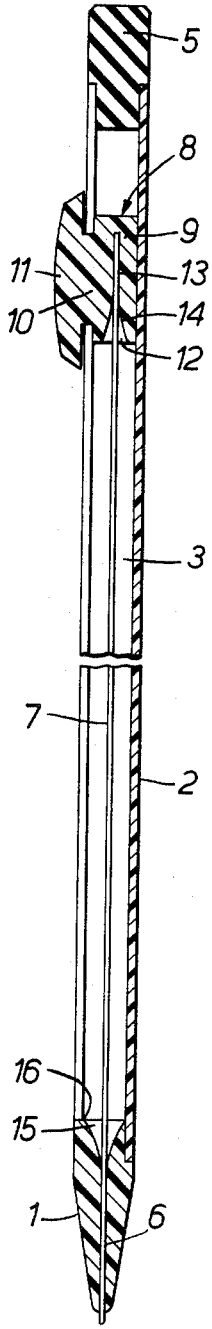
FIG. 2 is a longitudinal section through the pencil of FIG. 1.
Figure 3:
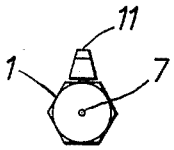
FIG. 3 is a front end view of the pencil of FIG. 1.

The pencil illustrated in FIGS. 1 to 3 has a plastic body consisting of a molded, generally conical forward or writing end part 1 and an extruded part 2 defining an axial bore 3 and a longitudinal slot 4 which opens into the bore and extends over a major part of the body length from the rear end. The body part 2 has a cross-section with a circular internal profile and a hexagonal external profile. An eraser 5 is inserted into the rear end of this part to close the bore 3 and the slot 4. The body part 1 includes a bore 6 of reduced diameter compared with bore 3 for accommodating with sliding clearance a length of lead 7. The trailing end of the lead is supported by a unitary molded slider 8 having a cylindrical core or lead follower 9 received slidably in the bore 3, a tongue 10 projecting radially from the follower 9 through the slot 4, and an outer head 11 which as shown takes the form of a raised sliding button.

The lead follower 9 includes a socket 12 including a cylindrical inner portion 13 in which the trailing end of the lead 7 engages with a tight friction fit whereby the lead is firmly gripped and supported by the slider 8. The mouth of the socket has a diameter substantially greater than (preferably at least twice) that of the lead 7. An inwardly tapering socket portion 14 extends from the mouth to the cylindrical portion 13 and is so shaped that a smooth transition exists between the two portions 13, 14. In this way any sharp edges which could, as a result of a shock, e.g. due to the pencil being dropped, subject the lead to shear stresses are positively eliminated. The smooth transition is achieved by forming the socket with the shape of a trumpet.

The risk of lead breakage is reduced further by providing the body part 1 with a recess 15 of similar shape to the socket 12 and leading into the bore 6 from the bore 3. The mouth 16 of recess 15 is of equal diameter to the bore 3 so that this recess also acts as a funnel to guide the tip of lead 7 into the bore 6 if it has been retracted completely into bore 3. In the case of recess 15, a smooth transition is provided between the tapering portion and the bore 6 so that sharp edges are again avoided.

The smooth transition zones of both the socket 12 and the recess 15, where the lead becomes free of lateral support, act to cushion the lead against shear stresses when the lead is subjected to sudden shocks whereby the chances of the lead fracturing are reduced to a satisfactory level.

The width of the slider tongue 10 is slightly greater than that of the slot 4 so that the side surfaces of the tongue and slot engage frictionally to oppose any displacement of the slider. One or more of the surfaces may be roughened to increase the frictional resistance.

During assembly the trailing end of the lead 7 is pushed into the socket 12 of the follower 9 and the interference fit between them ensures that the lead does not disengage from the slider when the latter is retracted or the pencil is dropped or otherwise subjected to shock. The body is assembled by pushing the two parts 1 and 2 together, and the slider 8 and lead 7 are introduced into the body 1, 2 through the open rear end which is then closed by the eraser 5. Thus, the pencil is both simple and inexpensive to manufacture. The slider is easily advanced along the body to adjust the length of lead projecting at the writing tip by finger pressure applied to the button 11, and during periods of non-use, the lead may be retracted to protect the writing tip by pushing back the slider 8. Substantially the whole length of lead may be used, except a small portion determined by the lengths of the body part 1 and the socket 12, e.g. about 2–3 cms. When the lead has been used up, the pencil is discarded.

Various modifications are possible without departing from the inventive concept. For example, the slider tongue and slot walls may be provided with teeth or other means which cooperate to define a ratchet mechanism permitting forward displacement of the slider but preventing any rearward displacement. Furthermore, the body could be made as a unitary molding instead of in two parts. Also the button of the slider may take the form of a pocket clip, or a clip may be molded onto the wall of the pencil if the whole body is made as a unitary molding.

Figure 4:
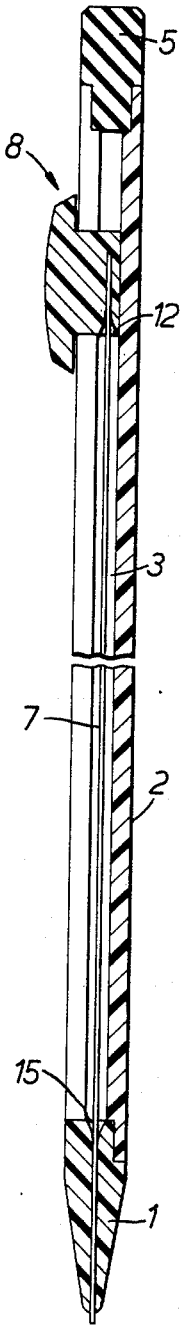
FIG. 4 is a longitudinal section showing an alternative embodiment of the invention.

The pencil illustrated in FIG. 4 is essentially the same as that of FIGS. 1 to 3 except the body part 2 is made of a self-skinning plastic foam and includes a bore 2 of smaller diameter, the mouth diameter of the socket 12 and recess 15 being correspondingly reduced. The use of self-skinning plastic foam enables a saving in manufacturing costs.

I claim:

1. A pencil comprising an elongate body having an axial bore within which is located a length of writing lead and a lead follower, the lead having a trailing end supported by the follower which is moveable longitudinally of the body to adjust the length of lead projecting at the forward end of the body, and wherein the follower includes a socket having an inner portion in which the trailing end of the lead is engaged with a friction fit, a mouth surrounding the lead with a substantial radial spacing therebetween, and a portion tapering inwardly to the inner portion and having a smooth transition therewith to thereby provide a smooth transition zone where the lead becomes free of lateral support to cushion the lead against shear stresses when the lead is subjected to sudden shock to reduce chances of lead fracturing.

2. A pencil as described in claim 1, wherein the socket mouth has a diameter at least twice that of the lead.

3. A pencil as described in claim 1 wherein the socket has the shape of a trumpet.

4. A pencil as described in claim 1 wherein a forward end portion of the bore is of reduced cross-section and receives the lead with a sliding fit, and the body includes a recess coaxial with said bore portion and having a mouth facing the lead follower, said recess tapering inwardly from the mouth and having a smooth transition with said bore portion to provide another said smooth transition zone at the forward end portion.

5. A pencil as described in claim 4, wherein the recess tapers smoothly from the mouth thereof to said bore portion.

6. A pencil as described in claim 5, wherein the mouth of the recess has a cross-section substantially equal to that of the portion of the bore connected directly therewith.

7. A pencil as described in claim 1 wherein the body includes a longitudinal disc slot opening into the bore with the lead follower projecting into said slot and engaging between the sides of the slot to restrain rearward displacement of the lead follower under normal writing pressure applied to the leading end of the lead.

8. A pencil as described in claim 7, wherein the lead follower is engaged frictionally between the sides of the slot.

9. A pencil as described in claim 8, wherein a portion of the follower or a side of a slot is roughened to increase the friction therebetween.

10. A pencil as described in claim 1 in which the body is made of a self-skinning plastic foam.

* * * * *